US011028699B2

(12) United States Patent
Lee

(10) Patent No.: US 11,028,699 B2
(45) Date of Patent: Jun. 8, 2021

(54) GAS TURBINE

(71) Applicant: DOOSAN HEAVY INDUSTRIES & CONSTRUCTION CO., LTD., Changwon-si (KR)

(72) Inventor: Jae Bin Lee, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 50 days.

(21) Appl. No.: 16/239,524

(22) Filed: Jan. 3, 2019

(65) Prior Publication Data

US 2019/0249553 A1 Aug. 15, 2019

(30) Foreign Application Priority Data

Feb. 9, 2018 (KR) ..... 10-2018-0016173

(51) Int. Cl.
*F01D 5/18* (2006.01)
*F01D 5/20* (2006.01)

(52) U.S. Cl.
CPC ..... *F01D 5/186* (2013.01); *F01D 5/20* (2013.01); *F05D 2240/307* (2013.01); *F05D 2260/202* (2013.01); *F05D 2260/22141* (2013.01)

(58) Field of Classification Search
CPC ..... F01D 5/20; F01D 5/186; F05D 2240/307
USPC ..... 416/92
See application file for complete search history.

(56) References Cited

U.S. PATENT DOCUMENTS 7,351,035 B2 * 4/2008 Deschamps ..... F01D 5/20 416/92
7,530,788 B2 * 5/2009 Boury ..... F01D 5/20 416/92
8,414,262 B2 * 4/2013 Hada ..... F01D 5/20 416/224
2012/0282108 A1 11/2012 Lee et al.
2014/0227103 A1 * 8/2014 Lee ..... F01D 5/20 416/97 R (Continued)

FOREIGN PATENT DOCUMENTS

KR 10-2011-0005902 A 1/2011

OTHER PUBLICATIONS

A Korean Office Action dated Apr. 9, 2019 in connection with Korean Patent Application No. 10-2018-0016173 which corresponds to the above-referenced U.S. application.

*Primary Examiner* — Eldon T Brockman
*Assistant Examiner* — Michael K. Reitz
(74) *Attorney, Agent, or Firm* — Invenstone Patent, LLC

(57) ABSTRACT

A gas turbine includes a housing in which combustion gas flows; a rotor section rotatably installed in the housing; and a turbine blade configured to rotate the rotor section by receiving a rotational force from the combustion gas and to be cooled by a cooling fluid flowing in a cooling path, the turbine blade including a tip side provided with tip cooling holes through which a portion of the cooling fluid in the cooling path is discharged from the turbine blade. The tip cooling holes include a first tip cooling hole formed in a pressure surface of the turbine blade, and a second tip cooling hole formed in a suction surface of the turbine blade. The gas turbine can easily maintain a gap between the tip side of the turbine blade and an inner circumferential surface of the housing, preventing degradation of the turbine blade efficiency.

12 Claims, 4 Drawing Sheets

(56) References Cited

U.S. PATENT DOCUMENTS

| | | | | |
|---|---|---|---|---|
| 2014/0255208 | A1* | 9/2014 | Yokoyama | F01D 5/20 416/97 R |
| 2015/0078916 | A1* | 3/2015 | Bedrosyan | F01D 5/20 416/97 R |
| 2019/0040747 | A1* | 2/2019 | Izumi | F01D 5/20 |

* cited by examiner

【FIG. 1】
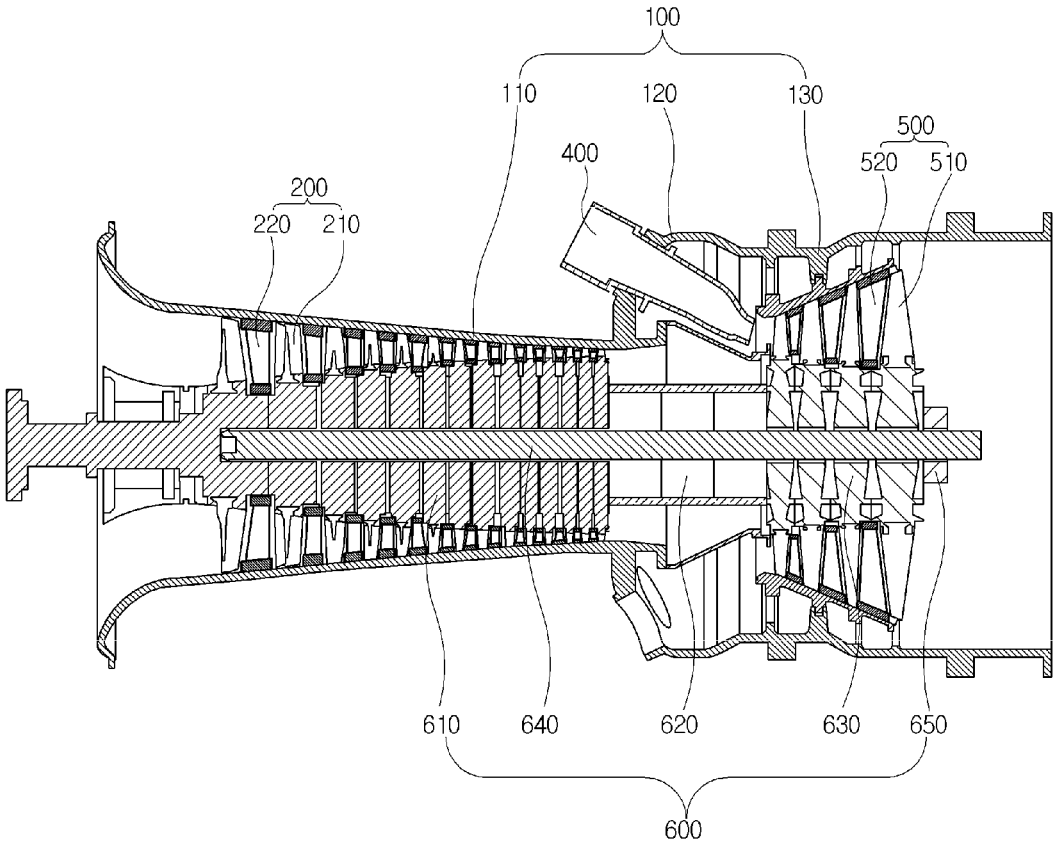

【FIG. 2】
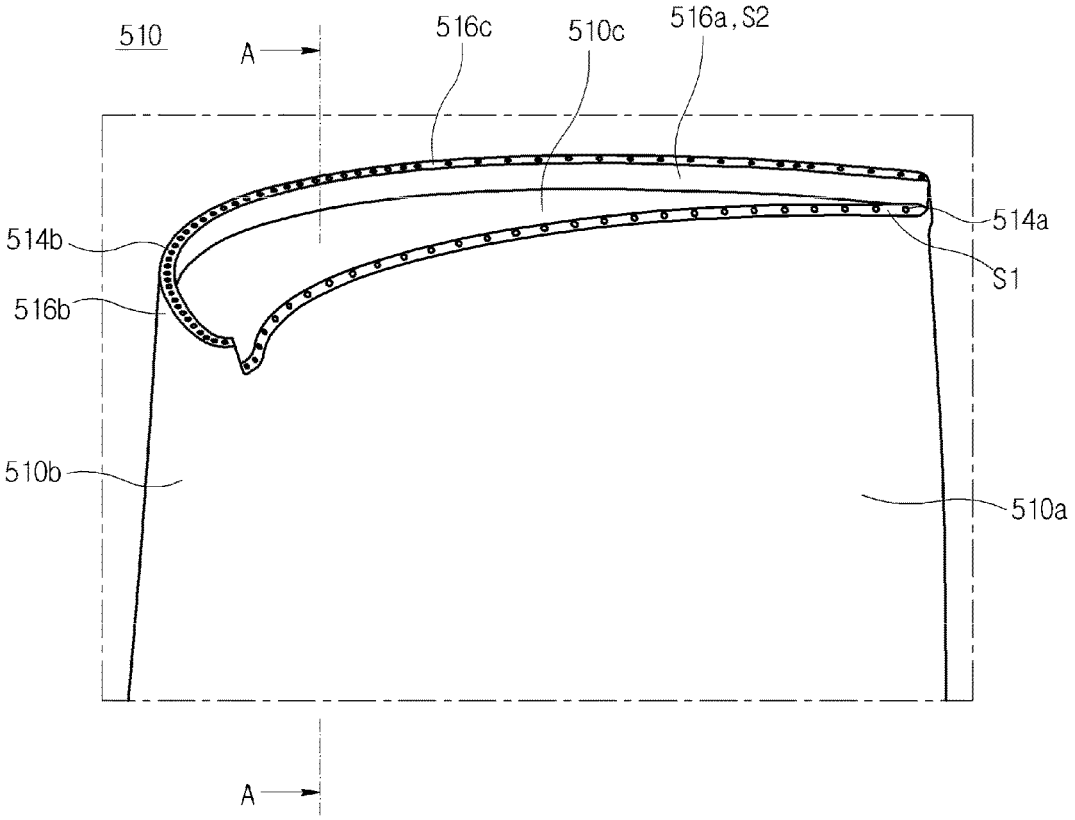

【FIG. 3】
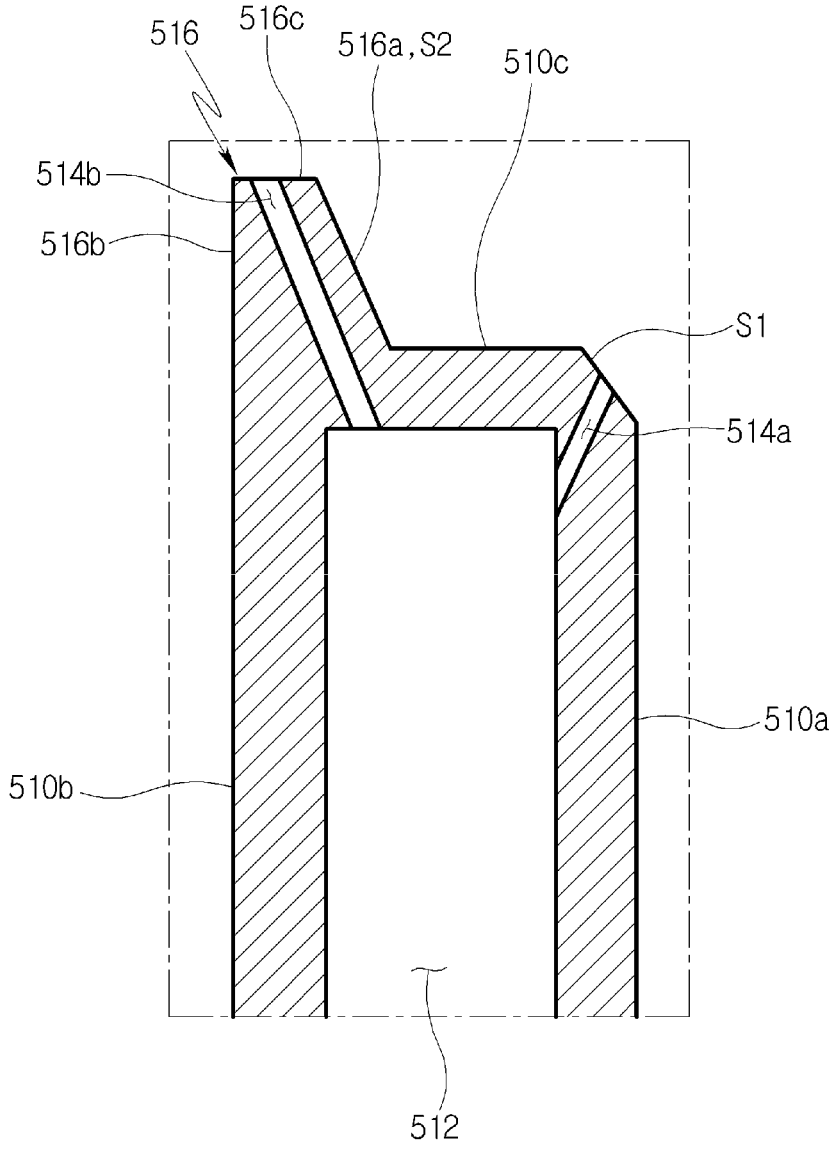

【FIG. 4】
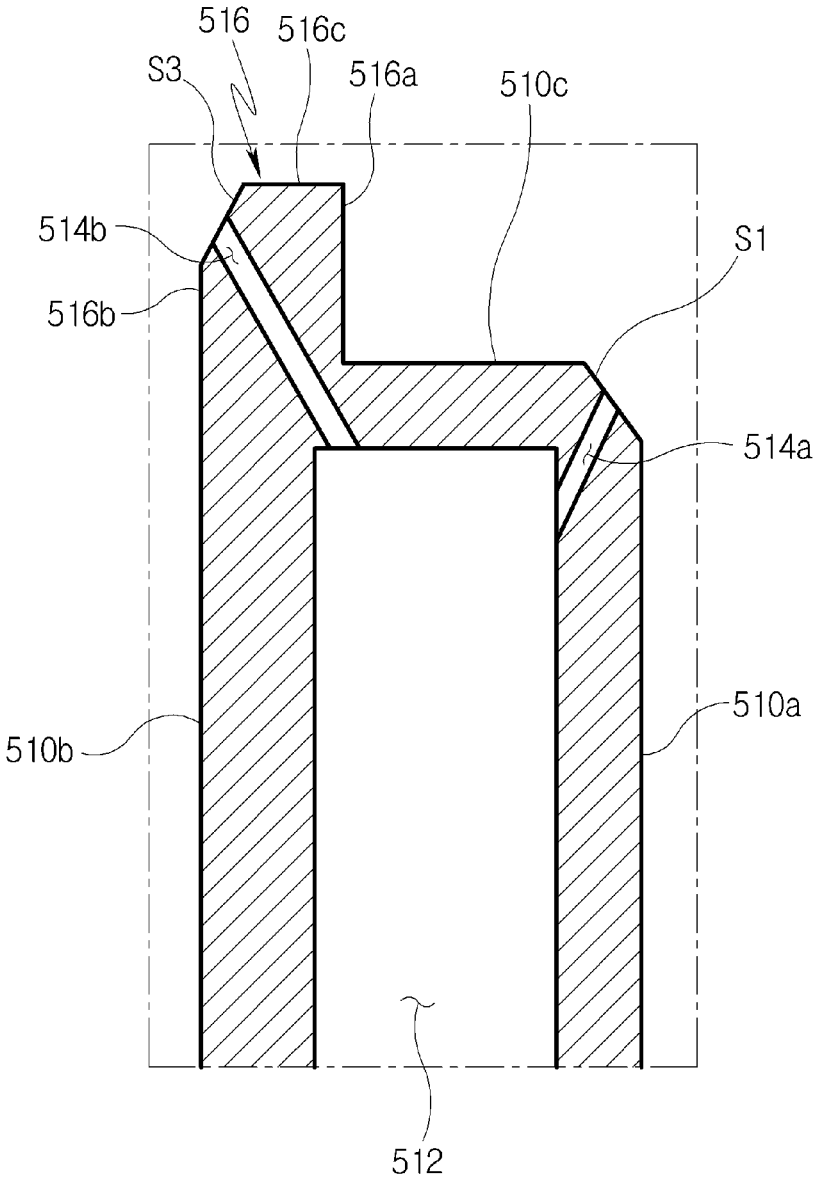

GAS TURBINE

CROSS REFERENCE TO RELATED APPLICATIONS

The present application claims priority to Korean Patent Application No. 10-2018-0016173, filed on Feb. 9, 2018, the entire contents of which are incorporated herein for all purposes by this reference.

BACKGROUND OF THE INVENTION

1. Field of the Invention

The present invention relates generally to a gas turbine.

2. Description of the Background Art

Generally, a turbine is a machine that converts kinetic energy of fluid such as water, gas, steam, etc. into mechanical work. Particularly, such a turbine generally includes a turbo-type machine in which a plurality of blades is installed on the periphery of a rotor so that steam or gas is directed onto the blades to create an impulse or reaction force, rotating the rotor at high speed. Examples of such turbines include a hydraulic turbine that utilizes the energy of elevated water, a steam turbine that uses the energy of the steam, an air turbine that uses the energy of high-pressure compressed air, and a gas turbine that uses energy of high-temperature and high-pressure gas.

Among them, the gas turbine includes a compressor section, a combustor section, a turbine section, and a rotor section. The compressor section includes a plurality of compressor vanes and a plurality of compressor blades which are alternately arranged. The combustor section supplies fuel to the air compressed in the compressor and ignites a fuel-air mixture with a burner to generate combustion gas of high temperature and high pressure. The turbine section includes a plurality of turbine vanes and a plurality of turbine blades which are alternately arranged. The rotor section is formed to pass through the center of the compressor section, the combustor section, and the turbine section, and both ends of the rotor section are rotatably supported by bearings such that one end is connected to a drive shaft of a generator. The rotor section includes a plurality of compressor disks coupled with the compressor blades, a plurality of turbine disks coupled with the turbine blades, and a torque tube transmitting torque from the turbine disks to the compressor disks.

In the gas turbine according to this configuration, the compressed air in the compressor is mixed with the fuel in the combustion chamber and combusted, thereby being converted into a high-temperature combustion gas. The generated combustion gas is injected toward the turbine section so that the combustion gas passes through the turbine blades to create a rotating force, thereby rotating the rotor section.

Since these gas turbines have no reciprocating mechanism such as piston of four-stroke engine, so that there is no mutual friction component like a piston-cylinder, the gas turbines have advantages that consumption of lubricating oil is extremely small, an amplitude feature which is characteristic of reciprocating machine is greatly reduced, and the gas turbines are able to operate at high speed.

Unlike the compressor section, the turbine section is in contact with a combustion gas at a high temperature and a high pressure, so that the turbine section requires a cooling means for preventing damage such as deterioration. To this end, the turbine section further includes a cooling path through which compressed air is additionally supplied from a portion of the compressor section to the turbine section, wherein the cooling path communicates with a turbine blade cooling path formed inside the turbine blade.

However, such a conventional gas turbine has a problem in that the tip end of the turbine blade is not cooled, thereby making it difficult to maintain the clearance between the tip end of the turbine blade and an inner circumferential surface of a housing of the gas turbine, and degrading the gas turbine efficiency.

SUMMARY OF THE INVENTION

Accordingly, the present invention has been made keeping in mind the above problems occurring in the related art, and an object of the present invention is to provide a gas turbine capable of cooling the tip end of a turbine blade.

According to an aspect of the present invention, a gas turbine may include a housing in which combustion gas flows; a rotor section rotatably installed in the housing; and a turbine blade configured to rotate the rotor section by receiving a rotational force from the combustion gas and to be cooled by a cooling fluid flowing in a cooling path, the turbine blade including a tip side provided with a tip cooling hole through which a portion of the cooling fluid in the cooling path is discharged from the turbine blade.

The tip cooling hole may include a first tip cooling hole formed in a pressure surface of the turbine blade to communicate with the cooling path.

The tip side of the turbine blade may include a first inclined surface for facilitating the formation of the first tip cooling hole.

The tip side of the turbine blade may include a first inclined surface formed between an end surface of the turbine blade and the pressure surface of the turbine blade, such that the first inclined surface is inclined with respect to each of the end surface and the pressure surface.

The first tip cooling hole may extend through the turbine blade from the cooling path to the first inclined surface.

The first tip cooling hole may extend in a direction perpendicular to the first inclined surface.

The tip cooling hole may include a second tip cooling hole formed in a suction surface of the turbine blade to communicate with the cooling path.

The tip side of the turbine blade may include a second inclined surface for facilitating the formation of the second tip cooling hole.

The gas turbine may further include a squealer rib extending centrifugally from the tip side of the turbine blade, between an end surface of the turbine blade and a suction surface of the turbine blade.

The second tip cooling hole may extend through the turbine blade from the cooling path to a surface of the squealer rib.

The squealer rib may include an upper rib surface that is spaced apart from the end surface of the turbine blade, wherein the second tip cooling hole extends through the turbine blade from the cooling path to the upper rib surface.

The squealer rib may further include a second inclined surface formed between the end surface and the upper rib surface such that the second inclined surface is inclined with respect to each of the end surface and the upper rib surface.

The second inclined surface may be spaced apart from the second tip cooling hole.

The second tip cooling hole may extend in a direction parallel to the second inclined surface.

The squealer rib may include an upper rib surface that is spaced apart from the end surface of the turbine blade; an outer rib surface that is coplanar with the suction surface of the turbine blade; and a third inclined surface formed between the upper rib surface and the outer rib surface such that the third inclined surface is inclined with respect to each of the upper rib surface and the outer rib surface.

The second tip cooling hole may extend through the turbine blade from the cooling path to the third inclined surface.

The second tip cooling hole may extend in a direction perpendicular to the third inclined surface.

The squealer rib may further include an inner rib surface forming a back surface of the outer rib surface, wherein the inner rib surface is parallel to the outer rib surface and is spaced apart from the second tip cooling hole.

According to an embodiment of the present invention, there is provided a gas turbine including a housing in which combustion gas flows; a rotor section rotatably installed in the housing; and a turbine blade configured to rotate the rotor section by receiving a rotational force from the combustion gas and to be cooled by a cooling fluid flowing in a cooling path. The turbine blade may include a tip side provided with a tip cooling hole through which a portion of the cooling fluid in the cooling path is discharged from the turbine blade, and an inclined surface for facilitating formation of the tip cooling hole.

According to an embodiment of the present invention, there is provided a gas turbine including a housing in which combustion gas flows; a rotor section rotatably installed in the housing; and a turbine blade configured to rotate the rotor section by receiving a rotational force from the combustion gas and to be cooled by a cooling fluid flowing in a cooling path, the turbine blade including a tip side provided with a tip cooling hole through which a portion of the cooling fluid in the cooling path is discharged from the turbine blade. The tip cooling hole may include a first tip cooling hole formed in a pressure surface of the turbine blade; and a second tip cooling hole formed in a suction surface of the turbine blade. The tip side of the turbine blade may include a squealer rib protruding centrifugally from the tip side of the turbine blade, between an end surface of the turbine blade and the suction surface of the turbine blade; and a first inclined surface formed between the end surface and the pressure surface, such that the first inclined surface is inclined with respect to each of the end surface and the pressure surface. The squealer rib may include an upper rib surface that is spaced apart from the end surface of the turbine blade; an outer rib surface that is coplanar with the suction surface of the turbine blade; an inner rib surface forming a back surface of the outer rib surface; and one of a second inclined surface inclined with respect to each of the end surface and the upper rib surface, and a third inclined surface inclined with respect to each of the upper rib surface and the outer rib surface.

BRIEF DESCRIPTION OF THE DRAWINGS

FIG. 1 is a cross-sectional view of a gas turbine according to an embodiment of the present invention;

FIG. 2 is a perspective view of the tip of a turbine blade in the gas turbine of FIG. 1;

FIG. 3 is a cross-sectional view taken along line A-A in FIG. 2; and

FIG. 4 is a cross-sectional view showing the tip of a turbine blade in a gas turbine according to another embodiment of the present invention.

DETAILED DESCRIPTION OF THE INVENTION

Hereinafter, exemplary embodiments of the present invention will be described in detail with reference to the accompanying drawings.

FIGS. 1-3 show a gas turbine according to an embodiment of the present invention. FIG. 2 shows the tip of a turbine blade in the gas turbine of FIG. 1, and FIG. 3 is a cross-sectional view taken along line A-A in FIG. 2.

Referring to FIG. 1, the gas turbine according to an embodiment of the present invention may include a housing 100, a rotor section 600 rotatably installed in the housing 100, a compressor section 200 that receives a rotating force from the rotor section 600 to compress the air introduced into the housing 100, a combustor section 400 that mixes the fuel with the air compressed by the compressor section 200 and ignites a fuel-air mixture to generate a combustion gas, a turbine section 500 that rotates the rotor section 600 by receiving a rotational force from the combustion gas generated from the combustor section 400, a generator that operates in association with the rotor section 600 for generating electricity, and a diffuser through which the combustion gas passed through the turbine section 500 is discharged.

The housing 100 includes a compressor housing 110 in which the compressor section 200 is accommodated, a combustor housing 120 in which the combustor section 400 is accommodated, and a turbine housing 130 in which the turbine section 500 is accommodated. Here, the compressor housing 110, the combustor housing 120, and the turbine housing 130 may be sequentially arranged from the upstream side to the downstream side in a flow direction of fluid.

The rotor section 600 may include a compressor disk 610 accommodated in the compressor housing 110, a turbine disk 630 accommodated in the turbine housing 130, a torque tube 620 accommodated in the combustor housing 120 to connect the compressor disk 610 and the turbine disk 630, and a tie rod 640 and a fastening nut 650 coupling the compressor disk 610, the torque tube 620, and the turbine disk 630.

The compressor disk 610 may consist of a plurality of compressor disks, which are arranged along an axial direction of the rotor section 600. That is, the compressor disks 610 may be arranged in multiple stages.

Each of the compressor disks 610 may have a substantially disk shape, a periphery of which is provided with a compressor disk slot into which a compressor blade 210, which will be described later, may be fitted. The compressor disk slot may be formed in the form of a fir-tree to prevent the compressor blade 210 from being detached from the compressor disk slot in the radial direction of rotation of the rotor section 600.

Here, the compressor disk 610 and the compressor blade 210 are typically coupled in a tangential type or an axial type. In this embodiment, the compressor disk 610 and the compressor blade 210 are formed to be coupled in an axial type. Accordingly, the compressor disk slot may consist of a plurality of compressor disk slots, which may be radially arranged along the circumferential direction of the compressor disk 610.

The turbine disk 630 may be formed similar to the compressor disk 610. That is, the turbine disk 630 may consist of a plurality of turbine disks, which may be arranged along the axial direction of the rotor section 600. That is, the turbine disks 630 may be arranged in multiple stages.

Each of the turbine disks 630 is formed in a substantially disk shape, a periphery of which is provided with a turbine disk slot into which a turbine blade 510, which will be described later, may be fitted.

The turbine disk slot may be formed in the form of a fir-tree to prevent the turbine blade 510 to be described later from being detached from the turbine disk slot in the radial direction of rotation of the rotor section 600.

Here, the turbine disk 630 and the turbine blade 510 are typically coupled as a tangential type or an axial type. In this embodiment, the turbine disk 630 and the turbine blade 510 are formed to be coupled in an axial type, although the present invention is equally applicable to a disk and blade coupled as a tangential type. The turbine disk slot may consist of a plurality of turbine disk slots, which may be radially arranged along the circumferential direction of the turbine disk 630.

The torque tube 620 is a torque transmission member for transmitting the rotational force of the turbine disk 630 to the compressor disk 610. The torque tube 620 may be provided at either end with a protrusion to respectively couple one end of the torque tube 620 to the farthest downstream compressor disk 610 and the other end to the farthest upstream turbine disk 630, that is, to each of the two disks adjacent to the torque tube 620. Grooves for engaging with the protrusions are respectively formed in the two adjacent disks 610 and 630 to prevent their relative rotation with respect to the torque tube 620.

The torque tube 620 may be formed in the shape of a hollow cylinder so that the air supplied from the compressor section 200 may flow through the torque tube 620 to the turbine section 500. Further, the torque tube 620 may have features rendering it resistant to deformation and distortion, which may occur in a gas turbine continuously operated for a long period of time, and rendering it easily assembled and disassembled for maintenance.

The tie rod 640 is formed to pass through the plurality of compressor disks 610, the torque tube 620, and the plurality of turbine disks 630, and has one end fastened to the farthest upstream compressor disk 610 and the other end protruding from the farthest downstream turbine disk 630 to be engaged with the fastening nut 650. Here, the fastening nut 650 tightens the farthest downstream turbine disk 630 towards the compressor section 200 to minimize the distance between the farthest upstream compressor disk 610 and the farther downstream turbine disk 630 by compressing the compressor disks 610, the torque tube 620, and the turbine disks 630 in the axial direction of the rotor section 600. Accordingly, axial movement and relative rotation of the plurality of compressor disks 610, the torque tube 620, and the plurality of turbine disks 630 can be prevented.

Meanwhile, in the present embodiment, one tie-rod 640 passes through the center of the plurality of compressor disks 610, the torque tube 620, and the plurality of the turbine disks 630, although the present invention is not limited to this configuration. That is, separate tie rods 640 may be respectively provided on the compressor section 200 and the turbine section 500, a plurality of tie rods 640 may be disposed radially along the circumferential direction, or a combination of these configurations may be used.

Both ends of the rotor section 600 may be rotatably supported by bearings, with one end connected to a drive shaft of a generator.

The compressor section 200 may include a compressor blade 210 rotated along with the rotor section 600 and a compressor vane 220 fixed to the housing 100 to align the flow of air flowing into the compressor blade 210.

The compressor blade 210 may consist of a plurality of compressor blades, which may be disposed in each of the multiple stages of the compressor disks 610 and may be arranged radially along the rotation direction of the rotor section 600 in each stage.

Each of the compressor blades 210 may include a plate-shaped platform portion, a root portion extending centripetally from the platform portion, and an airfoil portion extending centrifugally from the platform portion. The platform portion of one compressor blade 210 may be in contact with a neighboring platform portion, serving to maintain a gap between the airfoil portions. The root portion may be formed as a so-called axial type in which the root portion is inserted into the compressor disk slot along the axial direction of the rotor section 600 as described above. The root portion may be formed in a fir-tree shape corresponding to the compressor disk slot.

In this embodiment, the root portion and the compressor disk slot have a fir-tree configuration, but the present invention is not limited to this and may have a dovetail configuration or the like. Alternatively, the compressor blade 210 may be fastened to the compressor disk 610 by using fasteners such as keys or bolts. The compressor disk slot may be larger than the outline of the root portion so as to form a gap facilitating the engagement of the root portion with the compressor disk slot.

Although not separately shown, the root portion and the compressor disk slot are fixed by separate fins so that the root portion is prevented from being detached in the axial direction of the rotor section 600 from the compressor disk slot.

The airfoil portion of the compressor blade 210 may be configured to have an airfoil optimized according to the specification of a gas turbine, and may include a leading edge positioned on the upstream side of the compressor blade 210 to meet with the introduced air, and a trailing edge positioned on the downstream side of the compressor blade 210 toward the exiting air.

The compressor vane 220 may consist of a plurality of compressor vanes, which may be disposed according to each of the multiple stages of the compressor disks 610 and may be arranged radially along the rotation direction of the rotor section 600 in each stage. Here, the compressor vanes 220 and the compressor blades 210 may be alternately arranged along the flow direction of air.

Each of the compressor vanes 220 includes a platform portion, the respective platform portions collectively forming an annular shape along the rotating direction of the rotor section 600, and an airfoil portion extending from the platform portion in the radial direction of rotation of the rotor section 600.

The platform portion includes a root side platform that is proximal to the airfoil portion of the compressor vane and is fastened to the compressor housing 110 and a tip side platform that is distal to the airfoil portion opposite to the rotor section 600. Here, although the platform portion of the compressor vane according to the present embodiment includes the root side and tip side platforms for more stably supporting the airfoil portion of the compressor vane by supporting both the proximal and distal sides of the airfoil portion, the present invention is not limited to this. That is, the compressor vane platform portion may be formed to include only the root side platform to support only the proximal side of the compressor vane airfoil portion.

Each of the compressor vanes 220 may further include a root portion of the compressor vane for coupling the root side platform and the compressor housing 110.

The airfoil portion of the compressor vane 220 may be configured to have an airfoil optimized according to the specification of a gas turbine, and may include a leading edge positioned on the upstream side of the compressor vane 220 to meet with the introduced air, and a trailing edge positioned on the downstream side of the compressor vane 220 toward the exiting air.

The combustor section 400 mixes the air introduced from the compressor section 200 with fuel and combusts a fuel-air mixture to produce a high-temperature and high-pressure combustion gas. The combustor section 400 may be formed to increase the temperature of the combustion gas up to the heat resistance limit that the combustor section 400 and the turbine section 500 are able to withstand during an isobaric combustion process.

Specifically, the combustor section 400 may consist of a plurality of combustors, which may arranged along the rotational direction of the rotor section 600 in the combustor housing 120. Each combustor of the combustor section 400 includes a liner into which air compressed in the compressor section 200 flows, a burner that injects fuel into the air flowing into the liner and combusts the fuel-air mixture, and a transition piece through which the combustion gas generated in the burner is guided to the turbine section 500.

The liner may include a flame chamber constituting a combustion chamber, and a flow sleeve that surrounds the flame chamber to form an annular space.

The burner may include a fuel injection nozzle disposed at one end of the liner so as to inject fuel into the air flowing into the combustion chamber and an ignition plug provided on a wall of the liner to ignite the fuel-air mixture in the combustion chamber.

The transition piece may have an outer wall cooled by the air supplied from the compressor section 200 so as to prevent the transition piece from being damaged by the high temperature combustion gas. That is, the transition piece may be provided with a cooling hole through which air is injected into the transition piece for cooling. The air that has cooled the transition piece flows into the annular space of the liner and passes through cooling holes provided in the flow sleeve to collide with the outer wall of the liner.

Here, although not shown in the drawings, a deswirler serving as a guide may be disposed between the compressor section 200 and the combustor section 400 to adjust a flow angle of the air flowing into the combustor section 400 to a designed flow angle.

The turbine section 500 may be formed similarly to the compressor section 200.

That is, the turbine section 500 includes a turbine blade 510 rotated together with the rotor section 600, and a turbine vane 520 fixed to the housing 100 to align a flow of air flowing into the turbine blade 510.

The turbine blade 520 may consist of a plurality of the turbine blades, which may be disposed in each of the multiple stages the turbine disks 630 and may be arranged radially along the rotation direction of the rotor section 600 in each stage.

Each of the turbine blades 510 may include a plate-shaped platform portion, a root portion extending centripetally from the platform portion, and an airfoil portion extending centrifugally from the platform portion. The platform portion of one turbine blade 510 may be in contact with a neighboring platform portion, serving to maintain a gap between the airfoil portions. The root portion may be formed in a so-called axial type in which the root portion is inserted into the turbine disk slot along the axial direction of the rotor section 600 as described above. The root portion of the turbine blade may be formed in a fir-tree shape corresponding to the turbine disk slot.

In this embodiment, the root portion and the turbine disk slot have a fir-tree configuration, but the present invention is not limited to this and may have a dovetail configuration or the like. Alternatively, the turbine blade 510 may be fastened to the turbine disk 630 by using fasteners such as keys or bolts. The turbine disk slot may be larger than the outline of the root portion of the turbine blade so as to form a gap facilitating the engagement of the root portion with the turbine disk slot.

Although not separately shown, the root portion and the turbine disk slot are fixed by separate fins so that the root portion is prevented from being detached in the axial direction of the rotor section 600 from the turbine disk slot.

The airfoil portion of the turbine blade 510 may be configured to have an airfoil optimized according to the specification of a gas turbine, and may include a leading edge positioned on the upstream side of the turbine blade 510 to meet with the introduced combustion gas, and a trailing edge positioned on the downstream side of the turbine blade 510 toward the exiting combustion gas.

The turbine vane 520 may consist of a plurality of turbine vanes, which may be disposed according to each of the multiple stages of the turbine disks 630 and may be arranged radially along the rotation direction of the rotor section 600 in each stage. Here, the turbine vanes 520 and the turbine blades 510 may be alternately arranged along the flow direction of air.

Each of the turbine vanes 520 includes a platform portion, the respective platform portions collectively forming an annular shape along the rotating direction of the rotor section 600, and an airfoil portion extending from the platform portion in the radial direction of rotation of the rotor section 600.

The platform portion of the turbine vane includes a root side platform that is proximal to the airfoil portion of the turbine vane and is fastened to the turbine housing 130 and a tip side platform that is distal to the airfoil portion of the turbine vane opposite to the rotor section 600. Here, although the platform portion of the turbine vane according to the present embodiment includes the root side and tip side platforms for more stably supporting the airfoil portion of the turbine vane by supporting both the proximal and distal sides of the airfoil portion of the turbine vane, the present invention is not limited to this. That is, the turbine vane platform portion may be formed to include only the root side platform to support only the proximal side of the turbine vane airfoil portion.

Each of the turbine vanes 520 may further include a root portion of the turbine vane for coupling the root side platform portion and the turbine housing 130.

The airfoil portion of the turbine vane 520 may be configured to have an airfoil optimized according to the specification of a gas turbine, and may include a leading edge positioned on the upstream side of the turbine vane 520 to meet with the introduced combustion gas, and a trailing edge positioned on the downstream side of the turbine vane 520 toward the exiting combustion gas.

Here, unlike the compressor section 200, the turbine section 500 is in contact with a combustion gas at a high temperature and a high pressure, so that the turbine section 500 requires a cooling means for preventing deterioration and other damage.

To this end, the gas turbine according to the present embodiment further includes a cooling path through which compressed air is additionally supplied from a portion of the compressor section 200 to the turbine section 500. The air in the cooling path will be hereinafter referred to as a cooling fluid. The cooling path may have an external path (which extends outside the housing 100), an internal path (which extends through the interior of the rotor section 600), or both an external path and an internal path.

The cooling path communicates with a cooling path 512 (see FIG. 3) formed in the turbine blade 510, so that the turbine blade 510 can be cooled by the cooling fluid.

Like the turbine blade 510, the turbine vane 520 may be formed to be cooled by receiving a cooling fluid from the cooling path.

The tip of a turbine blade 510 occurs on the tip side of each turbine blade 510. The turbine section 500 requires a gap between the tip side of the rotating turbine blades 510 and an inner circumferential surface of the turbine housing 130 opposing the turbine blade tips, so that the turbine disks 630 and the turbine blades 510 can rotate smoothly.

As the gap between the tip side of the turbine blade 510 and the inner circumferential surface of the turbine housing 130 increases, it is advantageous in terms of preventing interference between the turbine blade 510 and the turbine housing 130, but disadvantageous in terms of the leakage of combustion gas. As the gap decreases, it is advantageous in terms of in terms of the leakage of combustion gas, but disadvantageous in terms of preventing interference between the turbine blade 510 and the turbine housing 130. Meanwhile, the flow of the combustion gas injected from the combustor section 400 is divided into a main flow passing through the turbine blade 510 and a leakage flow passing through the gap between the turbine blade 510 and the turbine housing 130. Therefore, as the gap increases, the leakage flow is increased to reduce the gas turbine efficiency, but interference between the turbine blade 510 and the turbine housing 130 due to thermal deformation or the like and resultant damage can be prevented. On the contrary, as the gap between the tip side of the turbine blade 510 and the inner circumferential surface of the turbine housing 130 decreases, the leakage flow is reduced to improve the gas turbine efficiency, but there is an increased risk of interference between the turbine blade 510 and the turbine housing 130 and damage may occur.

Accordingly, the gas turbine according to the present embodiment may further include a sealing means that secures a proper gap to minimize the deterioration of the gas turbine efficiency while preventing damage caused by interference between the turbine blades 510 and the turbine housing 130.

The sealing means may include a squealer rib 516 protruding centrifugally from the tip side of the turbine blade 510.

Consistent with the present invention, the squealer rib 516 may be formed on a pressure surface 510*a* of the turbine blade 510 as well as on a suction surface 510*b* of the turbine blade 510. To minimize an abnormal flow occurring due to the squealer rib 516, however, the squealer rib 516 may be formed only on one side of the turbine blade 510, preferably on the suction surface 510*b*, as shown in the embodiment per FIGS. 2 and 3. That is, the squealer rib 516 according to this embodiment may be disposed to protrude centrifugally from the turbine blade 510, between an end surface 510*c* of the turbine blade 510 and the suction surface 510*b* of the turbine blade 510.

Similarly, the turbine section 500 may further include a sealing means for blocking leakage between the turbine vane 520 and the rotor section 600.

In the gas turbine according to this configuration, the air introduced into the housing 100 is compressed by the compressor section 200, and the air compressed by the compressor section 200 is mixed with the fuel by the combustor section 400 to generate a fuel-air mixture. The fuel-air mixture is combusted by the combustor section to produce a combustion gas, which is then introduced into the turbine section 500 through the turbine blades 510 to rotate the rotor section 600, and is discharged to the atmosphere through the diffuser. The rotor 600, which is rotated by the combustion gas, can drive the compressor section 200 and the generator. That is, a portion of the mechanical energy obtained from the turbine section 500 may be supplied to the compressor section 200 as energy required to compress the air, and the remainder may be used to generate electric power using the generator.

The gas turbine according to the present embodiment may be configured such that a gap between the tip side of the turbine blade 510 (more precisely, the airfoil portion of the turbine blade) and the inner circumferential surface of the turbine housing 130 is maintained at a predetermined level (distance) so that the tip side of the turbine blade 510 can be sufficiently cooled.

Specifically, although the turbine blade 510 is cooled by the cooling path 512 of the turbine blade, since the tip side of the turbine blade 510, which directly influences the gap between the tip side of the turbine blade 510 and the inner circumferential surface of the turbine housing 130, is disposed remotely with respect the cooling path 512 of the turbine blade 510, the tip side of the turbine blade cannot be sufficiently cooled with the cooling path 512 of the turbine blade. As a result, there is a high risk of a collision between the tip side of the turbine blade 510 and the inner circumferential surface of the turbine housing 130 due to thermal expansion. In addition, when the gap between the tip side of the turbine blade 510 and the inner circumferential surface of the turbine housing 130 is increased for the purpose of safety, the gas turbine efficiency may be lowered.

Considering this, in the present embodiment, as illustrated in FIGS. 2 and 3, the tip side of the turbine blade 510 may be provided with tip cooling holes 514*a* and 514*b* through which a portion of the cooling fluid flowing through the cooling path 512 of the turbine blade is discharged to the outside of the turbine blade 510 so as to sufficiently cool the tip side of the turbine blade 510. This configuration can prevent a collision between the tip side of the turbine blade 510 and the inner circumferential surface of the turbine housing 130 while preventing the gap between the tip side of the turbine blade 510 and the inner circumferential surface of the turbine housing 130 from being increased.

Referring to FIGS. 2 and 3, the tip cooling holes 514*a* and 514*b* of the turbine blade may include a first tip cooling hole 514*a* formed in the pressure surface 510*a* of the turbine blade 510 so that the tip side of the turbine blade 510 is effectively cooled, and a second tip cooling hole 514*b* formed in the suction surface 510*b* of the turbine blade 510.

The first tip cooling hole 514*a* may extend through the turbine blade 510 from the cooling path 512 inside the turbine blade 510 to the junction of the end surface 510*c* of the turbine blade 510 and the pressure surface 510*a* of the turbine blade 510.

The first tip cooling hole 514*a* according to this configuration can cool the tip side of the turbine blade 510 with the cooling fluid passing through the first tip cooling hole 514*a*.

The first tip cooling hole 514*a* may form an air curtain with a cooling fluid discharged from the first tip cooling hole 514*a*, so that leakage gas flowing from the pressure surface 510*a* of the turbine blade 510 to the suction surface 510*b* of the turbine blade 510 through the tip gap between the tip side of the turbine blade 510 and the inner circumferential surface of the housing 100 can be reduced. Thus, the high-temperature leakage gas can be prevented from contacting the tip side of the turbine blade 510. Then, the leakage gas can be cooled. Accordingly, the tip side of the turbine blade 510 (precisely, the end surface 510*c* of the turbine blade 510) can be prevented from being excessively heated by the leakage gas.

Here, the first tip cooling hole 514*a* may be formed by drilling toward the suction surface 510*b* of the turbine blade 510 at a slant with respect to the radial direction of the rotor section 600 so as to communicate with the cooling path 512 of the turbine blade formed at the center of the turbine blade 510.

If the end surface 510*c* and the pressure surface 510*a* were to form a right-angled corner, a drilling process performed from such a corner would be performed unstably and defects would occur. Therefore, in consideration of this, in the present embodiment, in order to facilitate the formation of the first tip cooling hole 514*a*, a first inclined surface S1 may be formed between the end surface 510*c* and the pressure surface 510*a*. The first inclined surface S1 is inclined with respect to each of the end surface 510*c* and the pressure surface 510*a*. Thus, in the present embodiment, the first tip cooling hole 514*a* extends through the turbine blade 510 from the cooling path 512 to the first inclined surface S1. Then, since the drilling process is performed from the first inclined surface S1, the drilling process can be stably performed. Therefore, failures can be reduced and the first tip cooling hole 514*a* can be easily formed.

The first inclined surface S1 may be formed to be perpendicular to the extending direction of the first tip cooling hole 514*a* of the turbine blade in order to allow the drilling process to be more stably performed.

The second tip cooling hole 514*b* of the turbine blade may extend through the turbine blade 510 from the cooling path 512 of the turbine blade to a surface of the squealer rib 516.

Specifically, the squealer rib 516 may include an inner rib surface 516*a*, an outer rib surface 516*b*, and an upper rib surface 516*c*. The inner rib surface 516*a* forms a back surface of the outer rib surface 516*b*. The outer rib surface 516*b* is coplanar with the suction surface 510*b* of the turbine blade 510. The upper rib surface 516*c* is spaced apart from the end surface 510*c* by the same centrifugal distance that the squealer rib 516 protrudes from the end surface 510*c* of the turbine blade 510. The second tip cooling hole 514*b* extends through the turbine blade 510 from the cooling path 512 to the upper rib surface 516*c*.

The second tip cooling hole 514*b* according to this configuration can cool the tip side of the turbine blade 510 more effectively by using the cooling fluid passing through the second tip cooling hole 514*b*. That is, although the tip side of the turbine blade 510 is cooled by the cooling fluid passing through the first tip cooling hole 514*a* as described above, the tip side of the turbine blade 510 can be additionally cooled by the cooling fluid passes through the second tip cooling hole 514*b* of the turbine blade.

The second tip cooling hole 514*b* may form an air curtain with a cooling fluid discharged from the second tip cooling hole 514*b*, so that leakage gas flowing from the pressure surface 510*a* of the turbine blade 510 to the suction surface 510*b* of the turbine blade 510 through the tip gap between the tip side of the turbine blade 510 and the inner circumferential surface of the housing 100 can be further reduced. That is, although the leakage gas is reduced by the cooling fluid discharged from the first tip cooling hole 514*a* as described above, the leakage gas can be further reduced by the cooling fluid passing through the second tip cooling hole 514*b*. Thus, the high-temperature leakage gas can be prevented from contacting the upper rib surface 516*c* and the outer rib surface 516*b*. Then, the leakage gas can be further cooled. Accordingly, the upper rib surface 516*c* and the outer rib surface 516*b* can be prevented from being heated by the leakage gas.

Here, the second tip cooling hole 514*b* may be formed by drilling toward the pressure surface 510*a* of the turbine blade 510 at a slant with respect to the radial direction of the rotor section 600 so as to communicate with the cooling path 512 of the turbine blade formed at the center of the turbine blade 510.

If the inner rib surface 516*a* and the outer rib surface 516*b* were to be parallel to each other (for example, if the inner rib surface 516*a* were to extend in a directly radial direction), interference between the inner rib surface 516*a* and the second tip cooling hole 514*b* may occur. That is, part of the second tip cooling hole 514*b* may be exposed (disconnected) by the outer rib surface 516*b*. On the other hand, if the second tip cooling hole 514*b* were to be curved or bent to avoid the above problem, processing the second tip cooling hole would be difficult and manufacturing cost would increase. Furthermore, if the thickness of the squealer rib 516 (the distance between the inner rib surface 516*a* and the outer rib surface 516*b*) were to be increased, a flow of fluid may be disturbed by the squealer rib 516.

Therefore, in consideration of the above, in the present embodiment, in order to facilitate the formation of the second tip cooling hole 514*b*, a second inclined surface S2 may be formed between the end surface 510*c* of the turbine blade and the upper rib surface 516*c*. The second inclined surface S2 is inclined with respect to each of the end surface 510*c* and the upper rib surface 516*c*. That is, inner rib surface 516*a* may be inclined with respect to each of the end surface 510*c* and the upper rib surface 516*c*. The second inclined surface S2 may be spaced apart from the second tip cooling hole 514*b* so as to prevent a portion of the second tip cooling hole 514*b* from being exposed (disconnected). Accordingly, it is not required to curve or bend the second tip cooling hole 514*b*, so that the second tip cooling hole 514*b* can be easily formed and increased manufacturing cost can be avoided. Further, it is not required to increase the thickness of the squealer rib 516, so that a flow of fluid is not disturbed by the squealer rib 516.

The second inclined surface S2 may preferably be parallel to the second tip cooling hole 514*b* so as to ensure that the second inclined surface S2 is more reliably spaced apart from the second tip cooling hole 514*b*.

According to this configuration, in the gas turbine according to the present embodiment, the first tip cooling hole 514*a* and the second tip cooling hole 514*b* are formed, so that the tip side of the turbine blade 510 can be sufficiently cooled. As a result, the gap between the tip side of the turbine blade 510 and the inner circumferential surface of the housing 100 can be easily maintained, and the gas turbine efficiency can be prevented from being degraded.

As the first and second inclined surfaces S1 and S2 are formed, the first and second tip cooling holes 514*a* and 514*b* can be easily formed.

In the meantime, in the present embodiment, although the second tip cooling hole 514*b* is inclined from the upper rib surface 516*c* to the cooling path 512 of the turbine blade so that the inner rib surface 516*a* is inclined (to form the second inclined surface S2), the present invention is not limited to this configuration.

That is, as illustrated in FIG. 4, the inner rib surface 516*a* may be parallel to the outer rib surface 516*b* (to omit the second inclined surface S2), a third inclined surfaced S3 may be provided between the upper rib surface 516*c* and the outer rib surface 516*b*, and the second tip cooling hole 514*b* may extend through the turbine blade 510 from the cooling path 512 to the third inclined surface S3. Here, the third inclined surface S3 is inclined with respect to each of the upper rib surface 516*c* and the outer rib surface 516*b*.

In this case, like the first tip cooling hole 514*a* and the first inclined surface S1, the drilling process is performed from the third inclined surface S3, so that the drilling process can be stably performed. Accordingly, failures can be reduced, and the second tip cooling hole 514*b* can be easily formed. Here, the third inclined surface S3 may preferably be formed to be perpendicular to the extending direction of the second tip cooling hole 514*b* so that the drilling process can be stably performed.

In this case, the inner rib surface 516*a* is required to be parallel with the outer rib surface 516*b* such that the width of the upper rib surface 516*c* is not excessively narrowed while the thickness of the squealer rib 516 is not excessively increased, and to be spaced apart from the second tip cooling hole 514*b* such that the second tip cooling hole 514*b* is not exposed (disconnected).

While the exemplary embodiments of the present invention have been described in the detailed description, the present invention is not limited thereto, but should be construed as including all of modifications, equivalents, and substitutions falling within the spirit and scope of the invention defined by the appended claims.

What is claimed is:

1. A gas turbine comprising:

a housing in which combustion gas flows;

a rotor section rotatably installed in the housing;

a turbine blade configured to rotate the rotor section by receiving a rotational force from the combustion gas and to be cooled by a cooling fluid flowing in a cooling path, the turbine blade including a tip side provided with a plurality of tip cooling holes through which a portion of the cooling fluid in the cooling path is discharged from the turbine blade, the tip side of the turbine blade forming a tip gap with respect to an inner circumferential surface of the housing through which leakage gas flows from a pressure surface of the turbine blade to a suction surface of the turbine blade; and a squealer rib extending centrifugally from the tip side of the turbine blade, between an end surface of the turbine blade and the suction surface of the turbine blade, wherein the squealer rib includes:

an upper rib surface spaced apart from the end surface of the turbine blade, an outer rib surface that is substantially perpendicular to the end surface of the turbine blade and extends in a radial direction continuously relative to the suction surface of the turbine blade, the outer rib surface extending radially at a slope equal to that of a radially outer portion of the suction surface of the turbine blade, and an inner rib surface forming a back surface of the outer rib surface and extending between the end surface of the turbine blade and the upper rib surface, wherein the cooling path of the turbine blade includes a first inner wall formed opposite to an outer portion of the pressure surface of the turbine blade, a second inner wall formed opposite to an outer portion of the suction surface of the turbine blade to be parallel to the first inner wall, and a third inner wall that is substantially perpendicular to the first and second inner walls and connects the first and second walls at a radially outer end of the cooling path, wherein the plurality of tip cooling holes include:

a first tip cooling hole formed in the pressure surface of the turbine blade so as to communicate with the first inner wall of the cooling path at a first communication point along the first inner wall and configured to discharge the cooling fluid and form a first air curtain for reducing the flow of the leakage gas through the tip gap, and a second tip cooling hole formed in the squealer rib so as to communicate with the third inner wall of the cooling path at a second communication point along the second inner wall and configured to discharge the cooling fluid and form a second air curtain for further reducing the flow of the leakage gas through the tip gap, the second tip cooling hole extending through the turbine blade from the cooling path to the upper rib surface, the second air curtain formed by an outlet of the second tip cooling hole that faces the inner circumferential surface of the housing and is disposed downstream from an outlet of the first tip cooling hole, wherein the first and third inner walls communicate with each other at a first perpendicular junction, the first perpendicular junction including a first surface portion of the first inner wall and a second surface portion of the third inner wall, the first surface portion including a flat surface extending from the first perpendicular junction to the first communication point, and wherein the second and third inner walls communicate with each other at a second perpendicular junction, the second perpendicular junction including a third surface portion of the second inner wall and a fourth surface portion of the third inner wall, the fourth surface portion including a flat surface extending from the second perpendicular junction to the second communication point.

2. The gas turbine of claim 1, wherein the tip side of the turbine blade includes a first inclined surface (S1) for facilitating the formation of the first tip cooling hole.

3. The gas turbine of claim 1, wherein the tip side of the turbine blade includes a first inclined surface (S1) formed between an end surface of the turbine blade and the pressure surface of the turbine blade, such that the first inclined surface is inclined with respect to each of the end surface and the pressure surface.

4. The gas turbine of claim 3, wherein the first tip cooling hole extends through the turbine blade from the cooling path to the first inclined surface (S1).

5. The gas turbine of claim 3, wherein the first tip cooling hole extends in a direction perpendicular to the first inclined surface (S1).

6. The gas turbine of claim 3, wherein the tip side of the turbine blade includes a second inclined surface (S2) for facilitating the formation of the second tip cooling hole.

7. The gas turbine of claim 3, wherein the inner rib surface of the squealer rib includes a second inclined surface (S2) formed between the end surface and the upper rib surface such that the second inclined surface is inclined with respect to each of the end surface and the upper rib surface.

8. The gas turbine of claim 7, wherein the second inclined surface (S2) is spaced apart from the second tip cooling hole.

9. The gas turbine of claim 7, wherein the second tip cooling hole extends in a direction parallel to the second inclined surface (S2).

10. The gas turbine of claim 6, wherein the inner rib surface is parallel to the outer rib surface and is spaced apart from the second tip cooling hole.

11. A gas turbine comprising:

a housing in which combustion gas flows;

a rotor section rotatably installed in the housing; and a turbine blade configured to rotate the rotor section by receiving a rotational force from the combustion gas and to be cooled by a cooling fluid flowing in a cooling path, the turbine blade including a tip side provided with a plurality of tip cooling holes through which a portion of the cooling fluid in the cooling path is discharged from the turbine blade, an inclined surface (S1, S2) for facilitating formation of the plurality of tip cooling holes, and a squealer rib extending centrifugally from the tip side of the turbine blade, between an end surface of the turbine blade and a suction surface of the turbine blade, wherein the tip side of the turbine blade includes an inclined surface (S1) formed between the end surface of the turbine blade and the pressure surface of the turbine blade, such that the surface is inclined with respect to each of the end surface and the pressure surface, wherein the cooling path of the turbine blade includes a first inner wall formed opposite to an outer portion of the pressure surface of the turbine blade, a second inner wall formed opposite to an outer portion of the suction surface of the turbine blade to be parallel to the first inner wall, and a third inner wall that is substantially perpendicular to the first and second inner walls and connects the first and second walls at a radially outer end of the cooling path, wherein the plurality of tip cooling holes include:

a first tip cooling hole formed in a pressure surface of the turbine blade to communicate with the first inner wall of the cooling path at a first communication point along the first inner wall, the first tip cooling hole extending through the turbine blade from the cooling path to the inclined surface (S1), and a second tip cooling hole formed in the squealer rib to communicate with the third inner wall of the cooling path at a second communication point along the second inner wall, wherein the first tip cooling hole forms an air curtain with a cooling fluid discharged from the first tip cooling hole, so that leakage gas flowing from the pressure surface of the turbine blade to the suction surface of the turbine blade through a tip gap between the tip side of the turbine blade and an inner circumferential surface of the housing can be reduced, wherein the second tip cooling hole forms an air curtain with a cooling fluid discharged from the second tip cooling hole, the second tip cooling hole having an outlet that faces the inner circumferential surface of the housing and is disposed downstream from an outlet of the first tip cooling hole so that leakage gas flowing from the pressure surface of the turbine blade to the suction surface of the turbine blade through the tip gap can be further reduced, wherein the first and third inner walls communicate with each other at a first perpendicular junction, the first perpendicular junction including a first surface portion of the first inner wall and a second surface portion of the third inner wall, the first surface portion including a flat surface extending from the first perpendicular junction to the first communication point, and wherein the second and third inner walls communicate with each other at a second perpendicular junction, the second perpendicular junction including a third surface portion of the second inner wall and a fourth surface portion of the third inner wall, the fourth surface portion including a flat surface extending from the second perpendicular junction to the second communication point.

12. A gas turbine comprising:

a housing in which combustion gas flows;

a rotor section rotatably installed in the housing; and a turbine blade configured to rotate the rotor section by receiving a rotational force from the combustion gas and to be cooled by a cooling fluid flowing in a cooling path, the turbine blade including a tip side provided with a plurality of tip cooling holes through which a portion of the cooling fluid in the cooling path is discharged from the turbine blade, wherein the cooling path of the turbine blade includes a first inner wall formed opposite to an outer portion of the pressure surface of the turbine blade, a second inner wall formed opposite to an outer portion of the suction surface of the turbine blade to be parallel to the first inner wall, and a third inner wall that is substantially perpendicular to the first and second inner walls and connects the first and second walls at a radially outer end of the cooling path, wherein the plurality of tip cooling holes include:

a first tip cooling hole (514*a*) formed in a squealer rib to communicate with the first inner wall of the cooling path at a first communication point along the first inner wall, and a second tip cooling hole (514*b*) formed in a suction surface of the turbine blade to communicate with the third inner wall of the cooling path at a second communication point along the second inner wall;

wherein the tip side of the turbine blade includes:

the squealer rib (516) protruding centrifugally from the tip side of the turbine blade, between an end surface of the turbine blade and the suction surface of the turbine blade, and a first inclined surface (S1) formed between the end surface and the pressure surface, such that the first inclined surface is inclined with respect to each of the end surface and the pressure surface;

wherein the squealer rib includes:

an upper rib surface (516*c*) that is spaced apart from the end surface of the turbine blade, an outer rib surface (516*b*) that extends continuously relative to the suction surface of the turbine blade, an inner rib surface (516*a*) forming a back surface of the outer rib surface, and a second inclined surface (S2) inclined with respect to each of the end surface and the upper rib surface, wherein the first tip cooling hole forms an air curtain with a cooling fluid discharged from the first tip cooling hole, so that leakage gas flowing from the pressure surface of the turbine blade to the suction surface of the turbine blade through a tip gap between the tip side of the turbine blade and an inner circumferential surface of the housing can be reduced, wherein the second tip cooling hole forms an air curtain with a cooling fluid discharged from the second tip cooling hole, the second tip cooling hole having an outlet that faces the inner circumferential surface of the housing and is disposed downstream from an outlet of the first tip cooling hole so that leakage gas flowing from the pressure surface of the turbine blade to the suction surface of the turbine blade through the tip gap can be further reduced, wherein the first and third inner walls communicate with each other at a first perpendicular junction, the first perpendicular junction including a first surface portion of the first inner wall and a second surface portion of the third inner wall, the first surface portion including a flat surface extending from the first perpendicular junction to the first communication point, and wherein the second and third inner walls communicate with each other at a second perpendicular junction, the second perpendicular junction including a third surface portion of the second inner wall and a fourth surface portion of the third inner wall, the fourth surface portion including a flat surface extending from the second perpendicular junction to the second communication point.

* * * * *